United States Patent [19]

Densch

[11] Patent Number: 4,543,048

[45] Date of Patent: Sep. 24, 1985

[54] STEPPED-DISC PUMP

[76] Inventor: Dietrich Densch, Am Gansberg 14, 5206 Neunkirchen-Seelscheid 2, Fed. Rep. of Germany

[21] Appl. No.: 612,982

[22] Filed: May 23, 1984

[30] Foreign Application Priority Data

May 25, 1983 [DE] Fed. Rep. of Germany ..... 3318859
Jun. 29, 1983 [DE] Fed. Rep. of Germany ..... 3323327

[51] Int. Cl.[4] ..... F04C 2/00; F04C 18/00
[52] U.S. Cl. ..... 418/191; 418/201
[58] Field of Search ..... 418/191, 201, 202

[56] References Cited

U.S. PATENT DOCUMENTS 3,941,521 3/1976 Weatherston ..... 418/9

FOREIGN PATENT DOCUMENTS 200547 7/1923 United Kingdom ..... 418/201
705774 3/1954 United Kingdom ..... 418/201

*Primary Examiner*—Leonard E. Smith
*Assistant Examiner*—Jane E. Obee
*Attorney, Agent, or Firm*—Sprung, Horn, Kramer & Woods

[57] ABSTRACT

The invention relates to a stepped-disc pump with at least two mutually engaging rotors rotating at the same speed in opposite directions and constructed from stepped discs arranged in a row on a shaft and each having only one engagement segment, adjacent stepped discs being in each case mutually offset by a defined angle and being constructed and arranged in such a way that, together with the casing, they form closed delivery chambers. The characteristic feature of the invention is that the offset angle $\alpha$ is equal to the angle $\beta$ which is obtained by connecting the points of intersection ($5_1$, $5_2$) of the envelope circles of the rotors (2, 3) to the centers ($M_1$, $M_2$) thereof, and that the offset angle $\alpha$ is equal to 360°/n, n being an integer greater than 3.

2 Claims, 4 Drawing Figures

$n=6$

STEPPED-DISC PUMP

Figure 1:
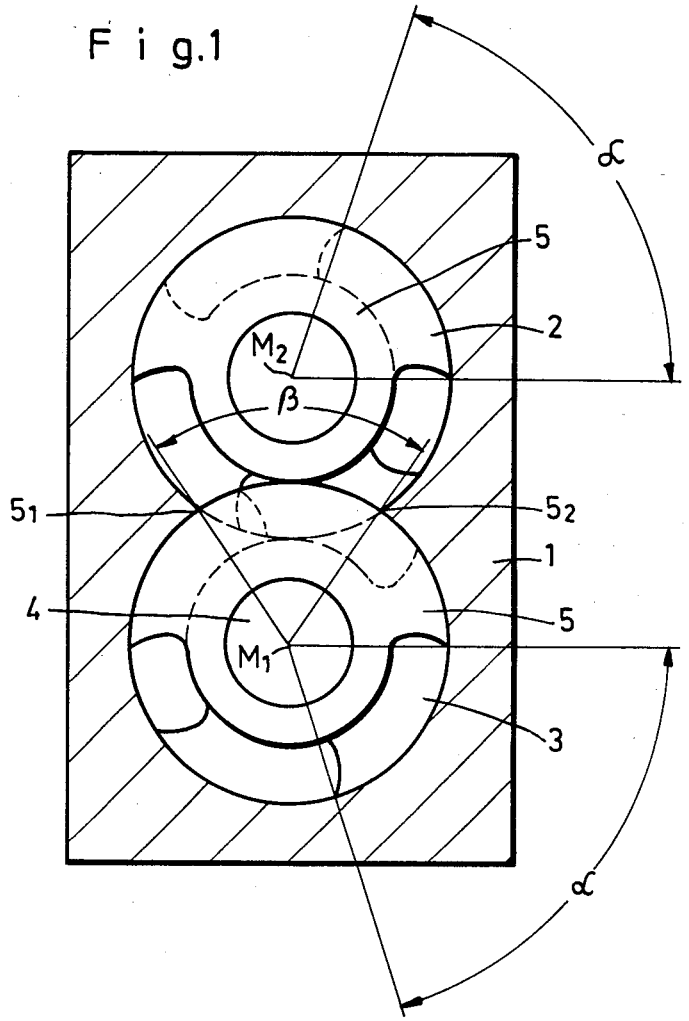

The invention relates to a stepped-disc pump with at least two mutually engaging rotors rotating at the same speed in opposite directions and constructed from stepped discs arranged in a row on a shaft and each having only one engagement segment, adjacent stepped discs being in each case mutually offset by a defined angle and being constructed and arranged in such a way that, together with the casing, they form closed delivery chambers.

Stepped-disc pumps of this type are known for example from French Patent Specification No. 694,484, Austrian Patent Specification No. 261,792 and German Patent Specification No. 917,230.

During the operation of such stepped-disc pumps, pressure fluctuations can periodically occur due to the fact that the medium being delivered must pass through a varying number of constrictions along the delivery route. Moreover, depending on the mutual offset angle of the discs during the operation of such stepped-disc pumps, chamber arrangements along the delivery route can form which entail a compression of the medium being delivered.

It is the object of the invention to improve a stepped-disc pump of the generic type in such a way that, during the rotation of the rotors, periodic pressure fluctuations or compression within the chambers, due to the changing number of the constrictions and unsuitable offset angles, are largely avoided, so that quieter running of the rotors is achieved. Attempts must therefore be made to take measures to ensure that the number of constrictions on engagement of the stepped discs remains constant and that the mutual offset angle of the stepped discs is selected such that chamber arrangements along the delivery route are formed which avoid compression of the medium being delivered. The latter is of great importance, in particular in the case of liquid media.

To achieve this object in a stepped-disc pump of the above generic type, it is proposed according to the invention that the offset angle $\alpha$ should be equal to the angle $\beta$ which is obtained by connecting the points of intersection of the envelope circles of the rotors to the centres thereof, and that the offset angle $\alpha$ should be equal to 360°/n, n being an integer greater than three.

As a result of arranging the stepped discs in a row on a shaft, the chambers are formed which are delimited outwards by the pump casing. By and large, the chambers are connected to one another in the form of a helical coil. The cross-section of the chambers can here remain unchanged, but it can also change within a pitch given by the offset angle.

The first case arises if the offset angle $\alpha$ is an even integral factor of 360°, for example if $\alpha$ is equal to 60°. If the offset angle $\alpha$ is an odd integral factor of 360°, for example $\alpha=72°$, the second case can arise, namely a chamber arrangement with changing cross-section.

In the two cases mentioned, unsteady running can occur since, in the first case, the varying number of constrictions in the chamber arrangements is possible and, in the latter case, changes in cross-section are also possible, which can lead to compression or pressure fluctuations.

In both cases, adherence to the rule according to the invention, namely $\alpha=\beta$ and $\alpha=360°/n$ with n as an integer greater than three, has the result that pressure fluctuations and/or compression are largely avoided.

Furthermore, according to an advantageous embodiment of the stepped-disc pump according to the invention, in order to achieve even better sealing, the offset angle $\alpha$ should be equal to 360°/n with n as an odd integer from 5 to 15.

An advantage in production engineering is obtained if the stepped discs of both rotors have the same cross-section.

If the engagement segment is delimited in a known manner by concave epicycloid sections, the interaction of opposite stepped discs of the two rotors results in continuous contact at the stepped transitions, so that good sealing is obtained and back-flow of material is prevented.

To avoid wear at the outer corners of the engagement segment, these corners can be rounded.

Thin spacer plates can be located between the stepped discs arranged in a row on a rotor. It is then easier to turn the rotor.

The stepped discs can in principle consist of any desired material, in particular of steel, sintered carbide or ceramics.

Figure 2:
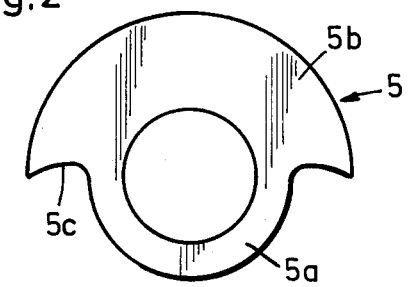
Figure 3:
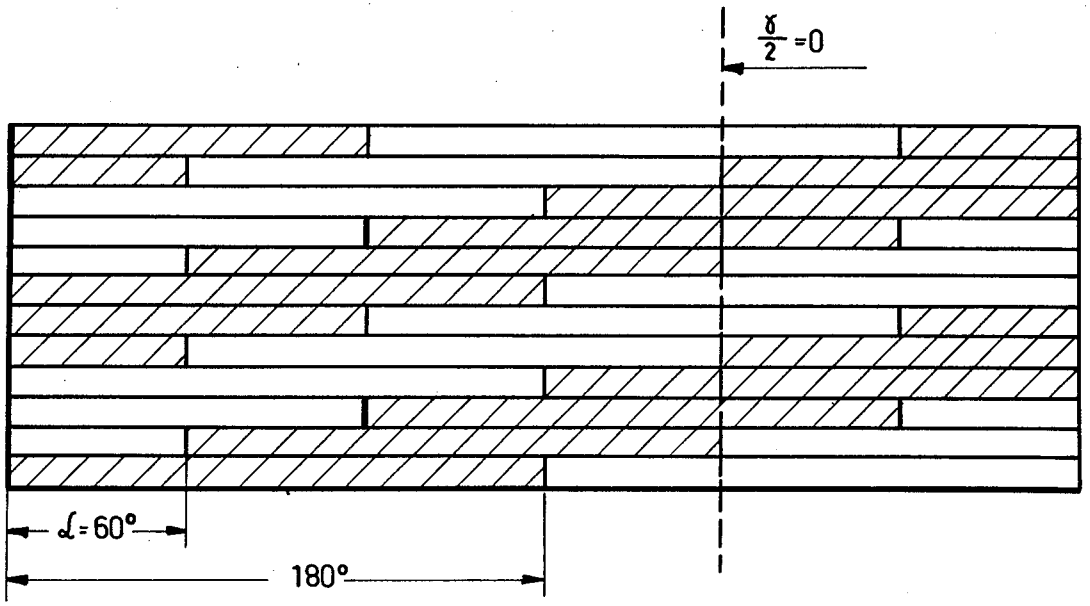
Figure 4:
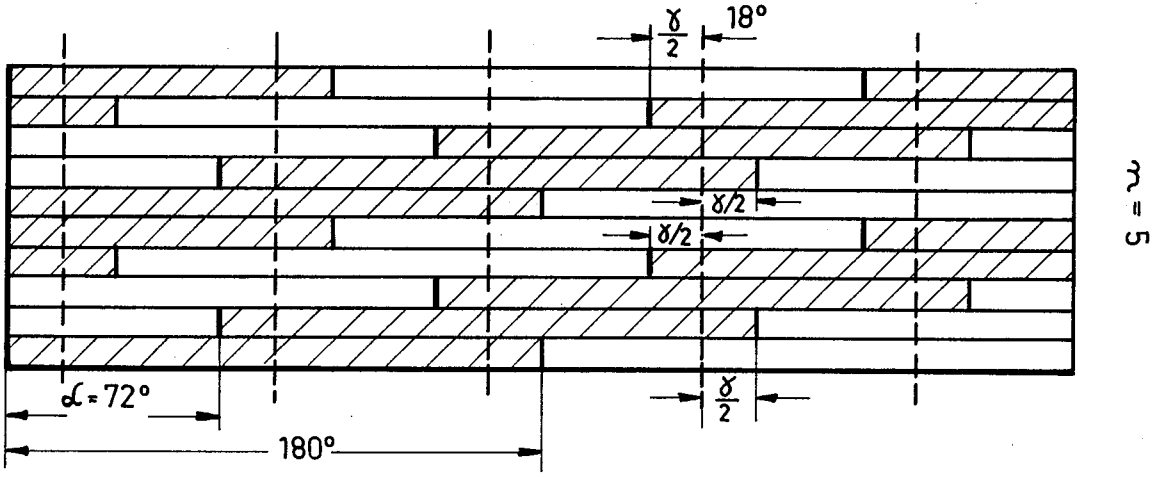

The invention is explained in more detail by reference to the drawing in which:

FIG. 1 shows a cross-section through the pump casing and the two rotors arranged therein and rotating in opposite directions, FIG. 2 shows a front view of a stepped disc, FIG. 3 shows the development of a rotor section with $\alpha=60°$ and FIG. 4 shows the development of a section of the rotor with n=5.

Two rotors 2, 3 which mutually engage under the angle $\beta$ are arranged one above the other in the pump casing 1. Each rotor 2, 3 has a shaft 4 on which stepped discs 5 are arranged in a row in the axial direction. Adjacent stepped discs 5 of the rotor 2 or 3 are mutually offset by the offset angle $\alpha$. According to the invention, the offset angle $\alpha$ is equal to the angle $\beta$ which is obtained by connecting the points of intersection $\mathbf{5}_1$, $\mathbf{5}_2$ of the envelope circles of the rotors 2, 3 to the centres $M_1$, $M_2$ thereof. As can be seen from FIG. 2, each stepped disc 5 has a central section 5*a* in the form of a circular ring and an engagement segment 5*b* which, in the illustrative embodiment, extends over a peripheral angle of 180°. In the peripheral direction, the engagement segment 5*b* is bounded by concave epicycloid sections 5*c*.

FIG. 3 shows an illustrative embodiment with section-wise development of the rotor periphery for an offset angle of $\alpha=60°$. The ridges of the engagement segments 5*b* of the stepped discs 5 are hatched.

Improved sealing becomes possible with the overlap by $\gamma/2$, shown in FIG. 4. Due to the geometries of this arrangement, the gap angle $\gamma$ can also be expressed by $\alpha/2$, that is to say $\gamma=\alpha/2$=half the offset angle. In the arrangement according to FIG. 4, sealing stepped discs 5 are thus also possible with an engagement segment 5*b* which covers a peripheral angle of at least $180°-\gamma$.

I claim:

1. A stepped disc pump comprising a casing, at least two mutually engaging rotors, each of which is mounted on a shaft, means for rotating said rotors at the same speed in opposite directions, each of said rotors having stepped discs arranged in a row on the shaft and each having only one engagement segment, adjacent stepped discs being in each case mutually offset by a defined angle and being constructed and arranged in such a way that, together with with said casing, they form closed delivery chambers, the offset angle $\alpha$ is equal to the angle $\beta$ which is obtained by connecting the points of intersection ($5_1$,$5_2$) of the envelope circles of said rotors (2,3) to the centers ($M_1$,$M_2$) thereof, and that the offset angle $\alpha$ is equal to 360°/n, n being an integer greater than three.

2. Stepped-disc pump according to claim 1, characterised in that the offset angle $\alpha$ is equal to 360°/n, n being an odd integer from 5 to 15.

* * * * *